United States Patent [19]

Ratowsky

[11] 3,981,488

[45] Sept. 21, 1976

[54] CARRIER FOR PROCESSING PHOTOGRAPHIC MATERIAL AND APPARATUS FOR ROTATING THE CARRIER

[75] Inventor: Simon Ratowsky, Downsview, Canada

[73] Assignee: Monrick Holdings Limited, Downsview, Canada

[22] Filed: Jan. 2, 1975

[21] Appl. No.: 538,004

[52] U.S. Cl. ..... 259/72; 354/329

[51] Int. Cl.[2] ..... B01F 9/00; G03D 3/04

[58] Field of Search ..... 259/72, 73; 354/307, 354/312, 323, 328, 329, 330, 331

[56] References Cited

UNITED STATES PATENTS

| | | | |
|---|---|---|---|
| 2,724,582 | 11/1955 | Huff | 259/72 |
| 3,705,544 | 12/1972 | Ratowsky | 354/329 X |
| 3,709,138 | 1/1973 | Brasher | 354/329 X |
| 3,735,961 | 5/1973 | Taylor | 354/330 X |
| 3,792,651 | 2/1974 | Banks | 354/330 X |
| 3,809,322 | 5/1974 | Hirosawa | 259/72 X |
| 3,840,214 | 10/1974 | Merz | 259/72 |

*Primary Examiner*—Fred L. Braun

[57] ABSTRACT

Apparatus for axially rotating and vertically oscillating a horizontally disposed cylindrical carrier for processing photographic material, in which a ring on one end of the carrier is supported on a rotatable eccentric and the other end of the carrier rests on rollers.

8 Claims, 2 Drawing Figures

CARRIER FOR PROCESSING PHOTOGRAPHIC MATERIAL AND APPARATUS FOR ROTATING THE CARRIER

The present invention relates to apparatus for oscillating a cylindrical carrier for the processing of photographic sheet or roll material.

A device now marketed for processing photographic material in sheet or roll form consists of a cylindrical carrier having spaced cams located circumferentially on the outside of the carrier cylinder, or on its end caps, for oscillating the carrier about a fulcrum located in its longitudinal axis when the carrier is rotated reciprocally. Such a device is described in U.S. Pat. No. 3,688,997 issued June 13, 1972, in the name of Simon Ratowsky assignor to Monrick Holdings Limited. A device for reciprocating such a carrier is described in U.S. Pat. No. 3,735,961 issued May 29, 1973, in the name of Gordon G. Taylor assignor to Monrick Holdings Limited. The device of Taylor suffers from the disadvantage that it is expensive to manufacture and it is not adjustable for carriers of different lengths.

It is an object of the present invention to provide a simplified apparatus for rotating and vertically oscillating a carrier for processing photographic material.

It is a further object of the invention to provide an apparatus for rotating and vertically oscillating a carrier for processing photographic material, which will accommodate carriers of different lengths.

Another object of the invention is to provide a carrier for use with such apparatus.

In its broadest aspect the invention resides in apparatus for axially rotating and vertically oscillating a horizontally disposed cylindrical carrier for processing photographic material, the carrier having a ring projecting longitudinally from at least one end thereof, comprising: a frame; vertically oriented eccentric means rotatably mounted on the frame and engagable with the ring of the carrier along the trackway thereof; support means rotatably mounted on the frame and spaced from the eccentric means; and drive means to rotate the eccentric means.

In another aspect the invention resides in a carrier for use with apparatus for rotating and vertically oscillating said carrier for processing photographic material, the carrier comprising a ring concentric therewith and extending longitudinally therefrom to form an inner trackway engagable with eccentric means of the apparatus.

The invention also resides in apparatus for processing photographic apparatus for processing photographic material, comprising: a frame; vertically oriented eccentric means rotatably mounted on the frame; support means rotatably mounted on the frame and spaced from the eccentric means; a carrier having a cylindrical drum with a ring mounted concentrically on the drum and extending longitudinally from one end thereof to form a trackway, the eccentric means being engagable with the ring along the trackway; and drive means to rotate the eccentric means whereby the carrier is rotated and simultaneously vertically oscillated.

An example embodiment of the invention is shown in the accompanying drawings in which.

Figure 1:
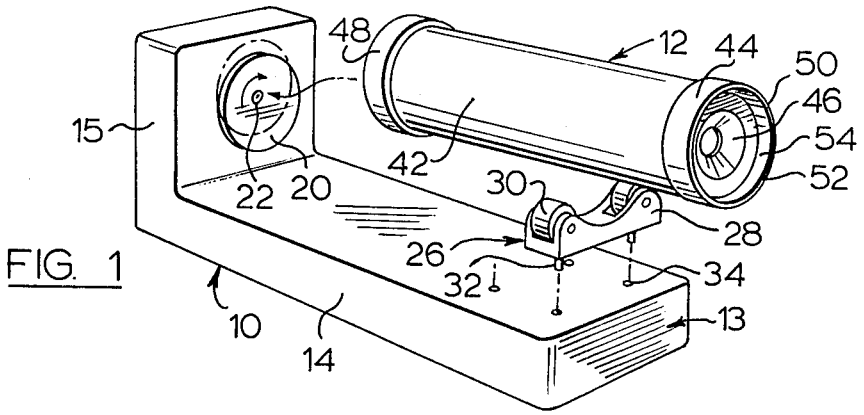
FIG. 1 is a perspective view of an apparatus according to the invention.
Figure 2:
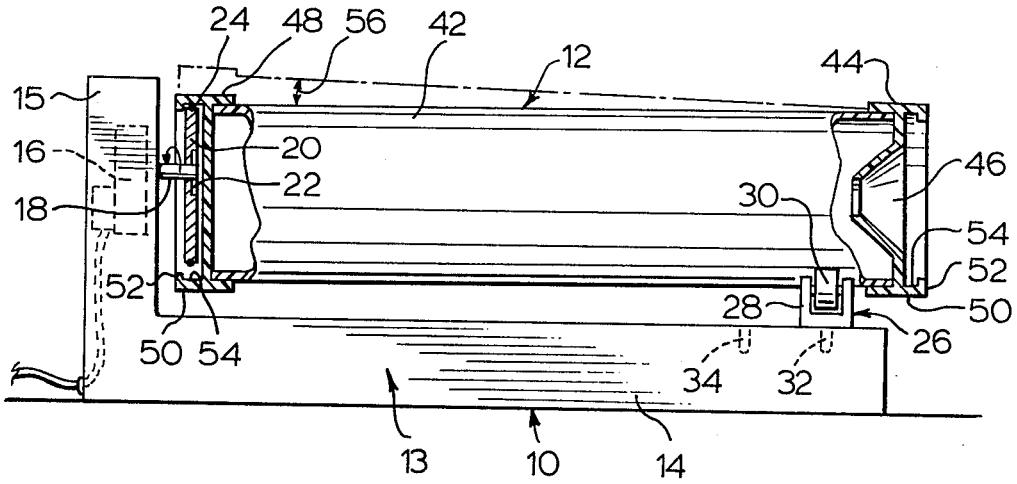
FIG. 2 is an elevational view, partly in cross-section, of the device shown in FIG. 1.

The apparatus of the example embodiment consists of an oscillating unit 10 and a carrier 12. Oscillatory unit 10 comprises a frame 13 having an elongated base 14 with an with an upstanding housing 15 at one end of the base. An electric motor 16 is mounted in housing 15 with a drive shaft 18 extending horizontally from the housing above the base 14. Eccentric means comprising a disc 20 is removably keyed on shaft 18 by a threaded bolt 22. Disc 20 carries a circumferential band 24 of material such as rubber having a high coefficient of friction.

A support 26 is located on base 14 of frame 13 remote from housing 15 and comprises an upstanding bracket 28 carrying a pair of freely rotatable spaced rollers 30. Bracket 28 has a pair of downwardly extending pins 32 which are removably received in a pair of holes 34 in base 14 of frame 13. A series of such pairs of holes 34 are located in base 14 at different distances from housing 15 and disc 20.

Carrier 12 comprises a cylindrical drum 42 with one end carrying a cap 44 having a funnel opening 46 for receiving liquid processing chemicals or water and the other end carrying a closure cap 48. A ring 50 extends from each end cap 44 and 48 concentric with drum 42. A shoulder 52 adjacent the free edge of ring 50 defines a trackway 54 on the inner surface of the ring.

In the operation of the example embodiment, carrier 12 is loaded with photographic sheet material and liquid processing chemicals or water in known manner and turned into a horizontal position. End cap 44 or 48 is then moved towards housing 15 to allow ring 50 to rest on eccentric disc 20 with friction band 24 bearing against trackway 54. The end portion or drum 42 remote from housing 15 is lowered to rest on rollers 30 after support 26 has been suitably located on base 14. When motor 16 is actuated, disc 22 rotates carrier 10 and the eccentricity of the disc on shaft 18 causes the carrier to oscillate vertically as indicated by arrows 56. During rotation, shoulder 52 on ring 50 prevents the ring from slipping off disc 20. After a predetermined time motor 16 is switched off and carrier is moved from oscillating unit 10 and emptied.

Either end cap 44 or end cap 48, or both, may be removable to load drum 42 and either or both end caps may carry a ring 50. Of course one end of drum 42 might be closed by a fixed bottom to form ring 50.

It will also be appreciated that eccentric disc 20 could be peripherally toothed and ring 50 could be internally toothed to provide a ring gear.

To accomodate a carrier 12 of a different length, support 26 may be shifted to another pair of holes 34 to have the carrier rest the support adjacent the end of the carrier remote from housing 15. Also, if desired, disc 20 may be replaced with a disc of a different diameter by removing screw 22 from shaft 18.

I claim:

1. Apparatus for axially rotating and vertically oscillating a horizontally disposed cylindrical carrier for processing photographic material, the carrier having a ring projecting longitudinally from at least one end thereof, to form an internal trackway, comprising:

a frame;

vertically oriented eccentric means rotatably mounted on the frame and engagable with the ring of the carrier along the trackway thereof;

support means mounted on the frame and spaced from the eccentric means, the support means carrying rotatable means for cradling the carrier remote from the ring thereof; and drive means to rotate the eccetric means.

2. Apparatus as claimed in claim 1 in which the support means is adjustable in spaced relationship with the eccentric means.

3. Apparatus as claimed in claim 1 in which the eccentric means comprises an offset disc carrying circumferentially a circular friction band.

4. Apparatus as claimed in claim 3 in which the disc is removably keyed on the drive means.

5. Apparatus as claimed in claim 1 in which the support means comprises a bracket and the rotatable means comprises a pair of laterally spaced rollers mounted for free rotation on the bracket.

6. Apparatus for processing photographic material, comprising:

a frame;

vertically oriented eccentric means rotatably mounted on the frame;

support means rotatably mounted on the frame and spaced from the eccentric means;

a carrier having a cylindrical drum with a ring mounted concentrically on the drum and extending longitudinally from one end thereof to form an internal trackway, the eccentric means being engagable with the ring along the trackway; and drive means to rotate the eccentric means whereby the carrier is rotated and simultaneously vertically oscillated.

7. Apparatus for processing photographic material, comprising:

a frame;

vertically oriented eccentric means rotatably mounted on the frame;

a carrier having a cylindrical drum with a ring mounted concentrically on the drum and extending longitudinally from one end thereof to form an internal trackway, the eccentric means being engagable with the ring along the trackway;

support means mounted on the frame and spaced from the eccentric means, the support means carrying rotatable means for cradling the carrier remote from the ring thereof; and drive means to rotate the eccentric means whereby the carrier is rotated and simultaneously vertically oscillated.

8. Apparatus as claimed in claim 7 in which the support means comprises a bracket and the rotatable means comprises a pair of laterally spaced rollers mounted for free rotation on the bracket.

* * * * *